US005199635A

United States Patent [19]

Abrams et al.

[11] Patent Number: 5,199,635

[45] Date of Patent: Apr. 6, 1993

[54] CONTAINER HAVING RECLOSABLE POUR SPOUT MOUNTED THEREON

[75] Inventors: Robert S. Abrams, Albany, N.Y.; Joseph H. Miller, Framington; Paul R. Bird, Naugatuck, both of Conn.

[73] Assignee: Capital Spouts, Inc., Fultonville, N.Y.

[21] Appl. No.: 753,855

[22] Filed: Sep. 3, 1991

Related U.S. Application Data

[63] Continuation-in-part of Ser. No. 634,439, Dec. 27, 1990, Pat. No. 5,108,029, which is a continuation-in-part of Ser. No. 465,848, Jan. 16, 1990, abandoned.

[51] Int. Cl.[5] ..... B65D 5/74

[52] U.S. Cl. ..... 229/125.09; 53/485; 220/359; 229/125.15; 493/87

[58] Field of Search ..... 229/125.09, 125.15; 222/556, 563, 566; 220/334, 339, 359; 493/87, 114, 962; 53/485, 489

[56] References Cited

U.S. PATENT DOCUMENTS

| | | | |
|---|---|---|---|
| 1,481,217 | 1/1924 | Maloy . | |
| 2,808,972 | 10/1957 | Flugge et al. | 222/566 |
| 2,901,800 | 9/1959 | Koehl . | |
| 2,986,309 | 5/1961 | Larson | 222/563 |
| 3,199,309 | 8/1965 | Bross | 222/556 |
| 3,412,919 | 11/1968 | Cain . | |
| 3,608,771 | 9/1971 | Monroe et al. . | |
| 3,998,354 | 12/1976 | Song . | |
| 4,669,640 | 6/1987 | Ando et al. | 220/269 |
| 4,813,578 | 3/1989 | Gordon et al. | 220/258 |
| 4,909,434 | 3/1990 | Jones et al. | 220/258 |
| 4,986,465 | 1/1991 | Jacobsson et al. | 229/125.09 |
| 5,108,029 | 4/1992 | Abrams et al. | 229/125.15 |

FOREIGN PATENT DOCUMENTS

| | | | |
|---|---|---|---|
| 435279 | 7/1991 | European Pat. Off. | 229/125.15 |

*Primary Examiner*—Gary E. Elkins

*Attorney, Agent, or Firm*—Burns, Doane, Swecker & Mathis

[57] ABSTRACT

A container for holding pourable contents includes an exterior surface, an interior surface, an interior for holding contents and a reclosable pour spout mounted on the container. The pour spout includes a flange member having oppositely positioned first and second sides. An aperture extends through the flange member and the second side of the flange member is secured to the outer periphery of the wall of the container. An extension is connected to and extends axially away from the outer surface of the container and the extension has an aperture extending therethrough that communicates with the aperture in the flange member. A stem is connected to and extends axially away from the second side of the flange member. The stem has an aperture extending therethrough that communicates with the aperture in the flange member and the pour spout is positioned on the container such that the stem extends through the opening in the wall of the container and into the interior of the container. At least a portion of the stem is turned outwardly and toward the interior surface of the wall to which the flange member is secured to produce a mechanical engagement between the turned stem and the container which tends to resist any tendency of the pour spout to be pulled from the container.

20 Claims, 2 Drawing Sheets

CONTAINER HAVING RECLOSABLE POUR SPOUT MOUNTED THEREON

This application is a continuation-in-part of application Ser. No. 07/634,439 filed on Dec. 27, 1990, now U.S. Pat. No. 5,108,029, which is a continuation-in-part of application Ser. No. 07/465,848, filed on Jan. 16, 1990, (now abandoned).

FIELD OF THE INVENTION

The present invention pertains to a pour spout and more particularly, to a container having a reclosable pour spout attached thereto.

BACKGROUND OF THE INVENTION

There are various types of devices that have been proposed for attachment to containers to facilitate the emptying of the contents from the container. For example, U.S. Pat. No. 4,813,578 discloses a pour spout provided with a flange portion for attaching the pour spout to the exterior surface of a container. The flange portion of the pour spout is attached to the exterior surface by heat sealing the plastic material from which the pour spout is fabricated to the plastic outer coating on the container. Such an arrangement is susceptible to certain improvements because it has been found that the securement of the pour spout to the container may deteriorate somewhat over time. In particular, once the pour spout is attached to a container, it is believed that the plastic layer on the container has a tendency to undergo additional curing or other changes. As a result, the adhesion at the interface between the flange portion of the pour spout and the outer surface of the container may be affected and diminished slightly, e.g., the plastic coating on the container may shrink slightly relative to the flange portion of the pour spout.

While this consideration is of concern in most all types of pour spouts that are secured to a container, it may be of particular concern in the case of pour spouts which have a flip top type of reclosable cap for closing the pour spout. In the case of pour spouts employing a flip top type of reclosable cap, an upwardly directed force is required to open the cap. If the integrity of the attachment of the pour spout to the outer surface of the container has been diminished in the foregoing manner, the force required to open the cap will contribute to further diminishing the secure attachment of the pour spout to the container.

U.S. Pat. No. 4,909,434 discloses a method of securing a pouring spout in liquid-tight relation to the innermost and outermost surfaces of a carton. The pouring spout is provided with a preformed flange and a liquid passageway oriented substantially perpendicular to the flange. The pouring spout is mounted on the carton by inserting the liquid passageway of the pouring spout through a hole that is cut in the carton. The flange is brought into contacting relation with the outer surface of the carton wall while the liquid passageway is deformed to form a second flange on the interior of the carton. Sufficient heat and pressure is then applied to the two flanges to continuously fuse the flanges to the innermost and outermost layers of the carton wall around the entire periphery of the hole in the carton. This pouring spout is also susceptible of various improvements.

SUMMARY OF THE INVENTION

To address the foregoing concerns and others, the present invention provides a pour spout that is attached to the container in a manner that is well suited for helping to ensure that the pour spout remains reliably and securely attached to the container and is not easily pulled from the container. In accordance with one aspect of the present invention, the container includes an exterior surface, an interior surface, an interior for holding contents and an opening extending through a wall thereof for permitting emptying of the contents from the container. The reclosable pour spout that is secured to the container includes a flange member having oppositely positioned first and second sides. An aperture extends through the flange member and the second side of the flange member is secured to the outer periphery of the wall of the container. An extension is connected to and extends axially away from the flange member and the extension has an aperture extending therethrough that communicates with the aperture in the flange member. A stem is connected to and extends axially away from the second side of the flange member and the stem has an aperture extending therethrough that communicates with the aperture in the flange member. The pour spout is positioned on the container such that the stem 15 extends through the opening in the wall of the container and into the interior of the container. A portion of the stem is turned outwardly and toward the interior surface of the wall to which the flange member is secured to produce a mechanical engagement between the turned stem and the container which tends to resist any tendency of the pour spout to be pulled from the container.

In accordance with another aspect of the present invention, a method of providing a container with a pour spout includes the steps of providing a pour spout having a hollow cylindrical portion and an annular flange member connected to and extending radially outwardly from a outer peripheral surface of the cylindrical portion, wherein the flange member is positioned intermediate opposite ends of the cylindrical portion and wherein the cylindrical portion has a part positioned between the flange member and one end of the cylindrical portion that defines a stem. The method also includes providing a container, mounting the pour spout on the container by inserting the stem into an opening in the container wall, and turning a portion of the stem outwardly to form an outwardly turned portion of the stem and turning the stem toward the inner surface of said container wall to form an upwardly turned portion of the stem.

BRIEF DESCRIPTION OF THE DRAWINGS FIGURES

DETAILED DESCRIPTION OF THE PREFERRED EMBODIMENTS

Figure 1:
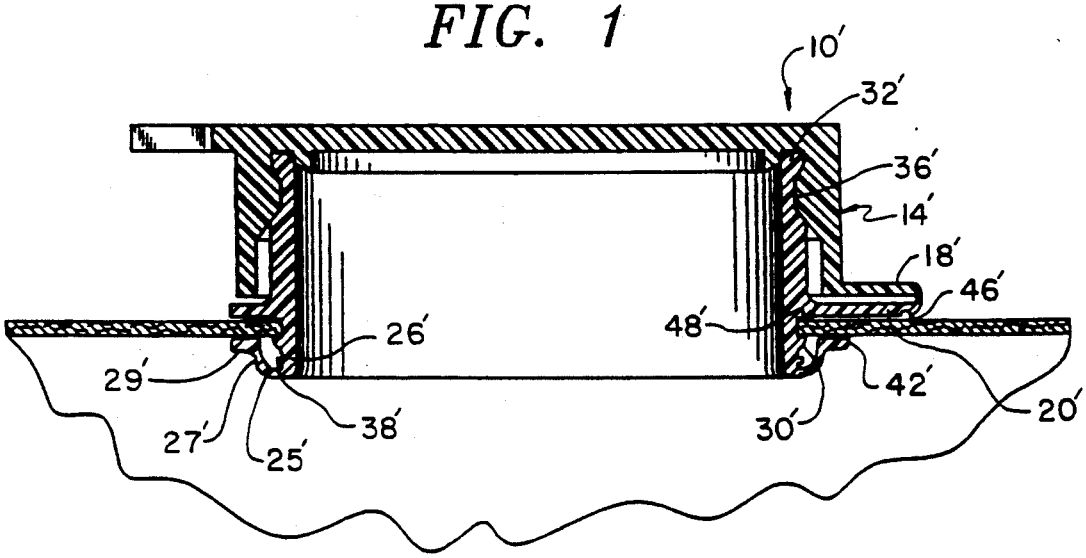
FIG. 1 is a cross-sectional side view of one embodiment of the reclosable pour spout according to the present invention attached to a container.

Referring initially to FIG. 1, only those features of the reclosable pour spout necessary for a proper understanding of the present invention will be described herein. For a more detailed description of the various features of the reclosable spout, reference is made to the aforementioned parent applications, application Ser. No. 634,439 filed on Dec. 27, 1990 and application Ser. No. 465,848 filed on Jan. 16, 1990, the entire disclosure of both of which is incorporated herein by reference.

Figure 2:
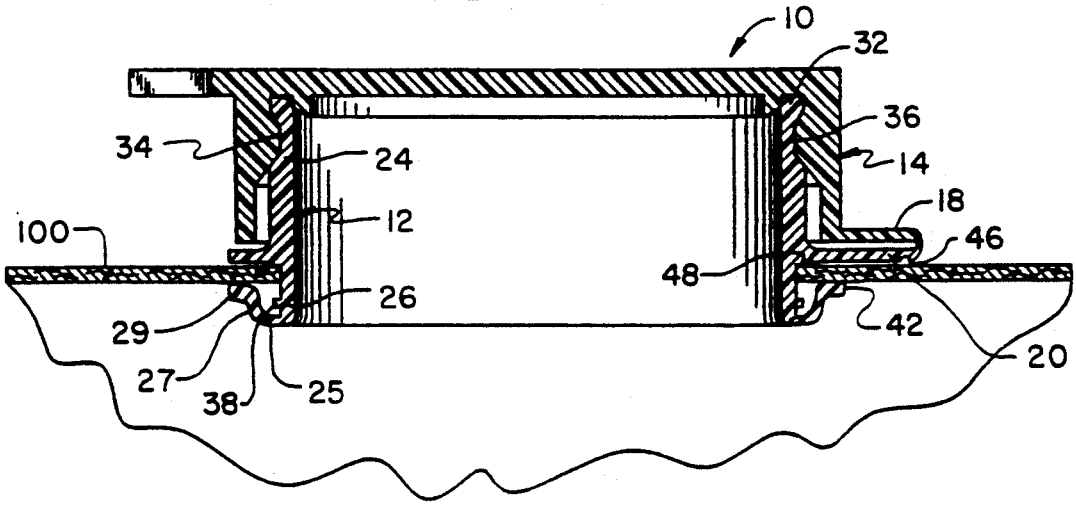
FIG. 2 is a cross-sectional side view of another embodiment of the reclosable pour spout according to the present invention attached to a container.

As seen in FIG. 2, the reclosable pour spout 10 according to the present invention includes a base member 12 and a cap 14. The cap 14 may be integrally connected to and formed in one piece with the base member 12. The cap 14 can be connected to the cap 14 by way of a strip of connecting material 18.

Figure 4:
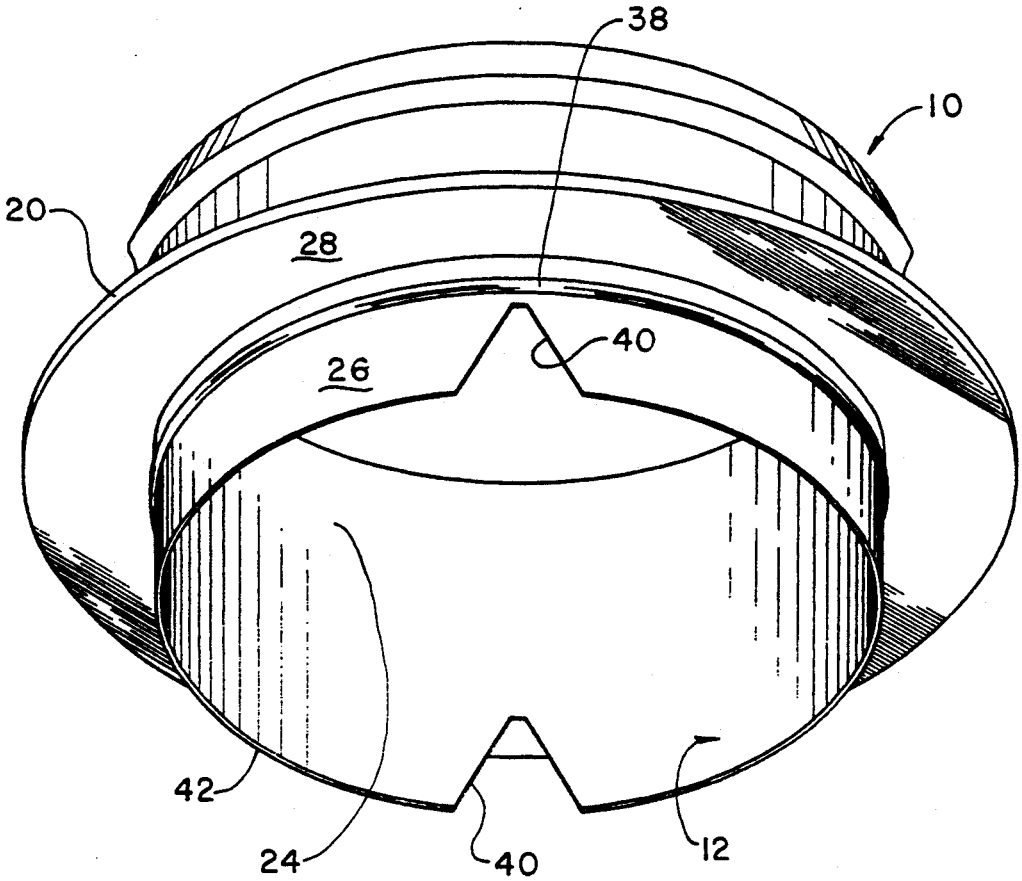
FIG. 4 is a bottom perspective view of the embodiment of the pour spout illustrated in FIG. I.

The base member 12 as illustrated in FIG. 4 is defined by a substantially planar flange member 20, an upwardly extending substantially cylindrical extension 24 and a downwardly extending substantially cylindrical stem 26. Preferably, the cylindrical extension 24, the cylindrical stem 26 and the flange member 20 are all formed integrally and in one piece from a suitable plastic material. In the embodiment illustrated in FIGS. 1 and 4, the stem 26 can have a substantially constant thickness along its length. The extension 24 and the stem 26 together define a hollow cylindrical portion and the flange member 20 surrounds that cylindrical portion at a point intermediate the ends of the cylindrical portion.

To provide the pour spout 10 with an extremely effective airtight and liquid-tight seal, it is desirable that the inner surface of the cap 14 and the outer peripheral surface of the cylindrical extension 24 interact with one another in the manner illustrated in the FIG. 2. Generally speaking, the extension 24 is provided with an annular ridge 32 and an annular recess 34 while the inner surface of the cap 14 is provided with an outwardly tapering part 36 that cooperates with the annular ridge 32 and the annular recess 34. Further details pertaining to the construction of the cylindrical extension 24 and the inner surface of the cap 14 are described more fully in the aforementioned application Ser. No. 634,439 and reference is made to that application for a more detailed description of those features.

One possible way of securing the pour spout 10 to the container 100 is by way of a suitable adhesive. The adhesive can be applied to the bottom surface 28 of the flange member 20 and the facing outer surface of the container 100. To help prevent the adhesive from flowing into the package and contaminating the contents, an annular barrier strip 38 is provided on the exterior surface of the cylindrical stem 26. The annular strip 38 functions as a barrier for inhibiting the adhesive from flowing beyond the barrier 38. The annular barrier strip 38 can be seen in the perspective view of FIG. 4.

As seen more clearly in FIG. 4, the cylindrical stem 26 is provided with oppositely positioned and generally V-shaped cutout portions 40. Preferably, the portion of the stem 26 below the barrier strip 38 and extending away from the flange member has a reduced thickness accomplished by maintaining the interior dimension identical with the remainder of the stem 26. The generally V-shaped cutout portions 40 help facilitate the process of forming the stem 26 from the initial configuration shown in FIG. 4 to the final configuration depicted in FIG. 2 in which the pour spout 10 is mounted on the container 100. It is to be understood that the description of the pour spout being mounted or secured to a container or a container body is meant to include the pour spout being attached to a container, to a container blank prior to formation into the container, and to a container blank in any intermediate stage of the container formation process.

Initially the pour spout 10 is placed on the container 100 by inserting the cylindrical stem 26 into the hole formed in the container 100. Thereafter, a suitably shaped plate is brought into contact with the free end 42 of the cylindrical stem 26 to cause a portion of the stem 26 to turn outwardly and form an outwardly turned portion 25, to turn slightly upwardly toward the wall of the container 100 to form an upwardly turned portion 27, and to turn outwardly again to form another outwardly turned portion 29. As can be seen from FIG. 2, the outwardly turned portion 29 preferably extends somewhat parallel to the wall of the container 100. Additionally, the outwardly turned portion 29 of the stem 26 is preferably in contact with the inner surface of the wall of the container 100. As an alternative to the specific construction shown in FIG. 2, the free end 42 of the stem 26 could be turned upwardly slightly such that the free end 42 of the stem 26 is in contact with the inner surface of the wall of the container 100.

By forming the stem 26 of the pour spout 10 relative to the container 100 in the manner illustrated in FIG. 2, the pour spout 10 is mechanically secured in place on the container 100. When an upwardly directed force is applied to the pour spout 10, such as might occur upon opening of the cap 14 or if the container is picked up by the pour spout, the outwardly turned portion 2 of the stem 26 rests against the inner surface of the container 100 and tends to distribute the upwardly directed force across the surface of the container. Thus, even if the interface between the flange member 20 and the outer surface of the container 100 is altered slightly as a result of further curing of the plastic layer on the container, the ability of the pour spout to be pulled away from the container will be substantially inhibited.

The embodiment of the pour spout shown in FIG. 1 is similar to that illustrated in FIG. 1 except that an annular ledge 30' is included that extends around the entire periphery of the cylindrical stem 26'. The annular ledge 30' is spaced from the bottom surface 28, of the flange member 20' by a distance that generally corresponds to the thickness of the container 100'. During fabrication of the container 100', a hole is formed in the container to receive the stem 26' of the pour spout 10'. It can be readily appreciated that due to the nature of the material from which the container 100' is fabricated, the periphery of the hole in the container 100' can be displaced slightly in the plane of the material when the cylindrical stem 26' is inserted into the hole. The portion of the container wall surrounding the stem 26' becomes, positioned between the ledge 30' and the bottom surface 28' of the flange member 20' in the manner illustrated in FIG. 1. As a result, the pour spout 10' is held in place relative to the container 100' in the axial direction so that the pour spout 10' can be securely attached to the container by suitable means. Thus, the ledge 30' helps to maintain the position of the pour spout 10' on the container 100' to help ensure that the pour spout 10' is securely attached to the container 100'.

It should be readily understood that the annular ledge 30' which extends completely around the outer periphery of the cylindrical stem 26' could be replaced with a plurality of spaced apart ledges which extend around a portion of the cylindrical stem, such as is disclosed in application Ser. No. 634,439.

Figure 3:
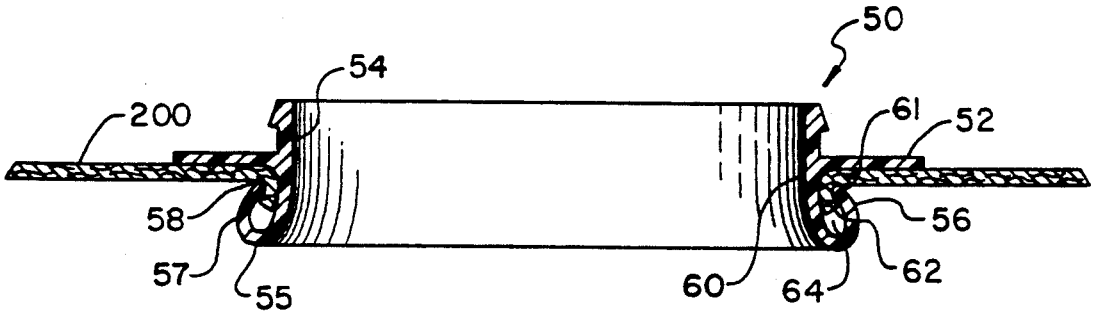
FIG. 3 is a cross-sectional side view of another embodiment of the reclosable pour spout according to the present invention attached to a container.

It can be readily seen from a review of FIGS. 1-3 that the outwardly turned portion 29, 29' of the stem 26, 26' is not sealed to the inner surface of the container 100. However, in certain applications, it may be desirable to secure the outwardly turned portion 29, 29' of the stem 26 to the inner surface of the container, such as for example by use of an adhesive.

To attach the pour spout 10, 10' to the container 100, 100', an adhesive is applied between the bottom surface 28, 28, of the flange member 20, 20' and the facing outer surface of the container 100, 100'. To help ensure that the adhesive does not flow outwardly beyond the outer edges of the flange 20, 20' and does not flow inwardly between the outer periphery of the stem 26, 26' and the inner periphery of the hole in the container, two annular ridges 46, 46', 48, 48' (shown in exaggerated scale) are provided on the bottom surface 28, 28' of the flange member 20, 20'. However, it may be desirable to eliminate the annular ridge 48, 48' so that adhesive can flow partially down the stem 26 to the annular barrier strip 38, 38' to aid sealing the hole in the container. Alternatively, additional adhesive/sealant can be applied to the stem 26 between the flange members 20, 20' and the annular barrier strip 38, 38' to accomplish essentially the same result while still preventing substantial adhesive in the interior of the carton. The annular ridges 46, 48 are also useful in helping to concentrate the adhesive in a confined annular area to thereby aid in proper securement of the pour spout 10, 10' to the container 100, 100'. The use of such annular ridges 46, 48 is described in the aforementioned application Ser. No. 634,439, and reference is made to that application for a more detailed description of that feature.

Turning to FIG. 3, another embodiment of the reclosable pour spout of the present invention is illustrated. To simplify the illustration and description, the integrally formed cap is not illustrated. However, it is to understood that the cap could be configured in the manner illustrated with respect to the embodiment shown in FIGS. 1 and 2.

As seen in FIG. 3, the reclosable pour spout 50 includes a flange member 52, an axially upwardly extending and integrally formed cylindrical extension 54 and an integrally formed and axially downwardly extending cylindrical stem 56. Although the cylindrical extension 54 is shown as having a slightly different configuration then that illustrated with respect to the embodiments shown in FIGS. 1 and 2, it is to be understood that the extension 54 could be configured in the same manner illustrated with respect to the embodiments shown in FIGS. 1 and 2.

In the embodiments shown in FIG. 3, the thickness of the cylindrical extension 56 can decrease from the flange member 52 to the free end 58 of the extension 56. The stem 56 is reduced in thickness to help facilitate the forming of the stem 56 in the manner necessary to result in the configuration shown in FIG. 3. Preferably, in the FIG. 3 embodiment, the V-shaped notches are not provided in the stem 56. Thus, the stem 56 is unbroken such that from the bottom surface of the flange member 52 to the free end 58 of the stem 56, the sem forms a complete cylindrical member.

The securement of the embodiment of the reclosable attachment shown in FIG. 1 to the container is effected by inserting the cylindrical stem 56 into the hole in the container 200. An adhesive can be applied between the bottom surface of the flange member 52 and the outer surface of the container 200 to secure the pour spout 50 to the container.

A tool can then be employed to form the cylindrical stem 56 into the configuration shown in FIG. 3. The tool is such that it causes the stem 56 to flair outwardly at a point 60 just below the flange member 52. This outward flaring of the stem 56 also causes the portion 62 of the container surrounding the hole periphery to flair downwardly toward the interior of the container and slightly outwardly, thereby defining a generally U-shaped crotch 61. In addition to causing a portion of the stem 56 to be turned outwardly to define an outwardly turned portion 55, the tool also causes a portion of the stem 56 to turn upwardly to define an upwardly turned portion 57. Additionally, the upwardly turned portion 57 is turned in towards the stem 56 so that the free end 58 of the stem 56 fits into the generally U-shaped crotch 61 formed by the turning of the portion 62 of the container. In a slightly altered construction, the upwardly turned portion 57 of the stem could be turned slightly less than that illustrated in FIG. 3 so that the free end 58 of the stem 56 faces and is substantially in contact with the inner surface of the container wall. In this latter alternative, the upwardly turned portion 57 of the stem could be somewhat perpendicularly arranged with respect to the container wall. Generally speaking, in the embodiment of the pour spout shown in FIG. 3, the portion of the stem 56 of the pour spout 50 that has been turned is substantially C-shaped in cross-section.

As a result of the formation of the stem 56 into the configuration shown in FIG. 3, the portion 62 of the container material surrounding the hole periphery is positioned within a substantially closed region 64 defined by the outwardly and upwardly turned portion of the stem 56. Such an arrangement can be advantageous in that any adhesive that may flow radially inwardly between the outer periphery of the stem 5 and the inner periphery of the hole in the container 200 will be prevented from flowing into the interior of the container and contaminating the contents in the container since it will be trapped within the enclosed region 64.

The formation of the stem 56 of the pour spout 50 relative to the container 100 in the manner shown in FIG. 3 produces a pour spout 50 that, like the embodiments illustrated in FIGS. 1 and 2, is mechanically secured in place on the container 200. Consequently, when an upwardly directed force is applied to the pour spout 50, such as might occur upon opening of the cap (not shown) or if the container 200 is picked up by the pour spout 50, the upwardly turned portion 57 of the stem 56 presses against the inner surface of the container 200, thereby resisting an tendency of the pour spout to be pulled out of the container 200. Thus, even if the integrity of the adhesion at the interface between the flange member 52 a the outer surface of the container 200 is diminished slightly as a result of further curing of the plastic layer on the container as noted above, the contact between the turned stem 56 and the inner surface of the container 200 will tend to prevent the pour spout 50 from being pulled out of the container 200.

While the embodiment of the pour spout illustrated in FIG. 3 is not illustrated as being provided with annular ridges on the bottom surface of the flange member 52 for purposes of confining the adhesive, it is to be understood that annular ridges similar to the annular ridges 46, 48 shown in FIG. 2 could be provided, if desired.

Although the embodiment of the pour spout 10 illustrated in FIGS. 1, 2 and 4 is described being mounted on the container through use of the described method of forming the upturned portion of the stem 26, it is to be understood that the method described for forming the upturned portion of the stem 56 illustrated in FIG. 3 and for mounting the pour spout 50 on the container could be used as an alternative, thereby resulting in downwardly and outwardly flared portions of the container. Similarly, the method described for mounting the pour spout 10 illustrated in FIGS. 1, 2 and 4 on the container could be employed in connection with the mounting of the pour spout 50 shown in FIG. 3.

It is also to be recognized that all of the embodiments of the pour spouts disclosed herein and described above could be provided with a tamper evident and accidental opening preventive feature for indicating if the pour spout has been tampered with and for helping to inhibit accidental opening of the pour spout. Various embodiments of such a tamper evident and accidental opening preventive feature are disclosed in the aforementioned application Ser. No. 634,439 and are incorporated herein by reference.

The principles, preferred embodiments and modes of operation of the present invention have been described in the foregoing specification. The invention that is intended to be protected herein should not, however, be construed as limited to the particular forms disclosed, as these are to be regarded as illustrative rather than restrictive. Variations and changes may be made by others and equivalents employed without departing from the spirit of the present invention. Accordingly, the foregoing detailed description should be considered exemplary in nature and it is expressly intended that all such variations, changes and equivalents which fall within the spirit and scope of the present invention as set forth in the attached claims, be embraced thereby.

What is claimed is:

1. A container for holding pourable material, comprising:

a container body having an exterior surface, an interior surface, an interior for receiving pourable material, and an opening extending through a wall thereof for permitting emptying of the material from the container; and a reclosable pour spout secured to the container body, said reclosable pour spout including:

a flange member having oppositely positioned first and second sides, and an aperture extending therethrough, the second side of the flange member being secured to the exterior surface of the wall of the container body, an extension connected to and extending axially away from the first side of the flange member, said extension having an aperture extending therethrough that communicates with the aperture in the flange member, and a stem connected to and extending axially away from the second side of the flange member, said stem having an aperture extending therethrough that communicates with the aperture in the flange member, said stem being comprised of a substantially axially extending portion that extends through the opening in the wall of the container body and an upwardly turned portion that extends toward the interior surface of the container body, a portion of said substantially axially extending portion extending beyond the interior surface of the container body toward the interior of the container body.

2. The container according to claim 1, wherein a portion of the wall of the container surrounding the opening is turned inwardly toward the interior of the container and is turned outwardly to thereby define a crotch, the stem having a free end that fits into said crotch.

3. The container according to claim 1, wherein the upwardly turned portion of the stem is connected to the substantially axially extending portion by an outwardly turned portion, the upwardly turned portion and the outwardly turned portion having two cutout portions formed therein.

4. The container according to claim 1, wherein the upwardly turned portion is connected to the substantially axially extending portion by an outwardly turned portion, said stem including another outwardly turned portion positioned adjacent the upwardly turned portion, said another outwardly turned portion extending substantially parallel to the interior surface of the container body.

5. The container according to claim 2, wherein the portion of the wall of the container surrounding the opening in the wall is flared inwardly towards the interior of the container and outwardly by the stem portion.

6. The container according to claim 5, wherein said stem decreases in thickness from the flange member toward a free end of the stem.

7. The container according to claim 1, wherein the upwardly turned portion of the stem has a thickness that is less than the thickness of the substantially axially extending portion of the stem.

8. The container according to claim 1, wherein said stem is devoid of cutout portions.

9. A method of providing a container with a pour spout, comprising the steps of:

providing a pour spout having a hollow cylindrical portion and an annular flange member connected to and extending radially outwardly from an outer peripheral surface of the cylindrical portion, said flange member being positioned intermediate opposite ends of the cylindrical portion, said cylindrical portion having a part positioned between the flange member and one end of the cylindrical portion that defines a stem;

providing a container having an opening formed in a wall thereof and having inner and outer surfaces;

mounting the pour spout on the container by inserting the stem into the opening in the container wall; and turning at least a portion of the stem outwardly to form an outwardly turned portion of the stem and turning the stem toward the inner surface of said container wall to form an upwardly turned portion of the stem.

10. The method in accordance with claim 9, including securing to the outer surface of the container wall to a surface of the flange member that faces the outer surface of the container wall.

11. The method in accordance with claim 10, wherein said surface of the flange member is secured to the outer wall of the container by an adhesive.

12. The method in accordance with claim 9, wherein the method includes flaring a portion of the wall of the container that surrounds the opening inwardly toward the interior of the container and outwardly to thereby define a crotch, and turning the upwardly turned portion of the stem such that a free end of the stem fits into said crotch.

13. The method in accordance with claim 11, including the step of inwardly flaring the portion of the container wall surrounding the opening by the turning of the stem portion.

14. The method in accordance with claim 9, wherein the has a free end, and the method includes a portion of said stem being turned outwardly adjacent the free end thereof to form outwardly turned portion of the stem.

15. The method in accordance with claim 14, wherein the another outwardly turned portion of the stem is formed to extend substantially parallel to the inner surface of said wall of the container.

16. The method in accordance with claim 15, wherein said another outwardly turned portion of the stem engages the inner surface of said wall of the container.

17. A container for holding pourable material, comprising:

a container body having an exterior surface, an interior surface, an interior for receiving pourable material, and an opening extending through a wall thereof for permitting emptying of the material from the container; and a reclosable pour spout secured to the container body, said reclosable pour spout including:

a flange member having oppositely positioned first and second sides, and an aperture extending therethrough, the second side of the flange member being secured to the exterior surface of the wall of the container body, an extension connected to and extending axially away from the first side of the flange member, said extension having an aperture extending therethrough that communicates with the aperture in the flange member, and a stem connected to and extending axially away from the second side of the flange member, said stem having an aperture extending therethrough that communicates with the aperture in the flange member, said stem extending through the opening in the wall of the container body and into the interior of the container, said stem comprising an upwardly turned portion formed by turning a portion of the stem, said stem having a first surface that forms an exterior surface of the stem prior to turning of the portion of the stem, at least a portion of the first surface of the upwardly turned portion being spaced from the interior surface of the container body.

18. The container according to claim 17, wherein the stem also includes a substantially axially extending portion that is connected to the upwardly turned portion by an outwardly turned portion.

19. The container according to claim 18, wherein said stem includes another outwardly turned portion positioned adjacent the upwardly turned portion, said another outwardly turned portion extending substantially parallel to the interior surface of the container body.

20. The container according to claim 18, wherein said substantially axially extending portion extends beyond the interior surface of the container body toward the interior of the container body.

* * * * *